United States Patent [19]

Nollen et al.

[11] Patent Number: 4,888,091

[45] Date of Patent: Dec. 19, 1989

[54] LOW DENSITY NONWOVEN ARAMID SHEETS

[75] Inventors: Dennis A. Nollen; Arthur A. Quinn, both of Newark, Del.

[73] Assignee: E. I. Du Pont De Nemours and Company, Wilmington, Del.

[21] Appl. No.: 616,104

[22] Filed: Jun. 1, 1984

Related U.S. Application Data

[63] Continuation-in-part of Ser. No. 500,473, Jun. 2, 1983, abandoned.

[51] Int. Cl.[4] ..... D21H 5/02

[52] U.S. Cl. ..... 162/109; 162/117; 162/146; 162/157.3; 162/192; 162/206

[58] Field of Search ..... 162/146, 100, 206, 101, 162/108, 201, 202, 117, 109, 192, 157.3

[56] References Cited

U.S. PATENT DOCUMENTS 4,515,656 5/1975 Memeger ..... 162/146

*Primary Examiner*—Peter Chin

[57] ABSTRACT

Less porous, more abrasion-resistant nonwoven aramid sheets are made by expanding a smooth-surface, dried, wet-laid sheet of fibrids and fibers, which has fused, nonexpandable, densified regions, segmented by spaced interruptions of nonfused regions of the sheet structure, in a pattern which encloses expandable portions of the sheet structure. The re-wet sheet is heated dielectrically to expand the interior of the nondensified portions without substantially roughening or disrupting their surface skin.

22 Claims, No Drawings

LOW DENSITY NONWOVEN ARAMID SHEETS

CROSS-REFERENCE TO RELATED APPLICATION

This application is a continuation-in-part of copending application Ser. No. 500,473 filed June 2, 1983 now abandoned.

DESCRIPTION

1. Technical Field

This invention relates to improved low-density nonwoven sheets comprised of aramid fibrids and short aramid fibers, having a smooth, less porous, abrasion resistant surface and to a process for making such sheets.

2. Background

Low density (less than 0.16 g/mL) nonwoven sheet structures comprised of aramid fibers and fibrids, as known from with U.S. Pat. No. 4,515,656, are useful in thermal and acoustical insulating applications, among other things. These low density materials are prepared from wet-laid sheets of a fibrid-fiber mixture which, without ever being dried, are expanded by rapid heating to form a coherent low density sheet having a plurality of paper-like layers of membranous elements which form expanded macroscopic cells substantially throughout the thickness of the sheet. Although the tensile strength and surface integrity and configuration of such known sheets are sufficient for many uses, other uses require less porous sheets with greater strength and surface abrasion resistance, than have been obtained with the sheets made by such a wet-laid never-dried process. Whereas drying of these known wet-laid sheets, such as by passing over smooth heated cans or rolls, provides denser sheets with smooth surfaces and can result in a stronger tougher sheet material, previous attempts to expand such dried sheets to the much lower densities needed for some applications were unsuccessful.

Consequently one object of this invention is a process for expanding such fibrid-fiber wet-laid nonwoven aramid sheets after once being dried. Another object of this invention is an improved low density sheet structure comprised of aramid fiber and aramid fibrids having improved tensile strength, surface continuity and integrity and abrasion resistance. Still another object is such sheet structures having sufficient flexibility and fire-resistance for use in fire-blocking sheets in upholstered furniture and similar applications where a thin, flexible, light-weight fire-resistant material is needed.

BRIEF DESCRIPTION OF THE INVENTION

Under properly selected conditions, wet-laid paper-like nonwoven sheets of aramid fibrid/fiber mixtures can be dried, re-wet and expanded to provide novel sheet structures of low density which have uniformly expanded portions with a smooth, dense, skin-like, outer surface; which expanded portions can have, as desired, interior structures ranging from ones sponge-like in nature to ones open and balloon-like (air-filled); and which sheet structures have a low porosity which resists penetration by water.

A product of this invention is a low density, nonwoven sheet structure consisting essentially of a commingled mixture of from 30 to 90% by weight of aramid fibrids and complementally from 70 to 10% by weight of short aramid fibers, said sheet comprising at least about 30% by weight fusible aramid, the sheet having uniformly expanded portions enclosed by a pattern of fused, densified regions segmented by spaced interruptions of nonfused regions with the expanded portions being comprised of a chamber formed by two opposed, dense, smooth, skin-like surface strata of said fibrids and fibers, which two strata enclose a much less dense interior, the sheet having a sufficiently low porosity to provide a Drip Porosity Test time of at least about 10 seconds. The discrete expanded portions are preferably enclosed by fused densified regions arranged in geometric patterns of segmented lines. Segmentation of such densified lineal regions has been found to improve both the uniformity of and under certain conditions the degree of expansion in the expanded portions of the sheet structure.

The products of this invention have substantially improved abrasion resistance over products of the prior art prepared by a wet-laid never-dried expanding process. The improved products can have an abrasion resistance as measured in the Taber Abrasion Test of at least 1000, and preferably at least 2000 cycles to failure.

As known in the art and as used herein the terms "short fibers" and "floc" are used interchangeably in reference to fibers of short length customarily used in the preparation of such wet-laid paper-like sheets. Fiber lengths suitable for this use normally are less than about 2.5 cm, and most preferably less than about 0.68 cm. Suitable linear densities of the fibers are from 0.55 to 11.1 dtex, and preferably in the range of 1.0 to about 3.5 dtex. For a maximum strength and resistance to shrinkage it is preferred that the short fibers be cut from highly drawn and heat-stabilized filaments. The "fibrids" used herein are the all synthetic, small, nongranular, flexible, fibrous or film-like particles as known in the art as taught for example in the above European patent application and as described in U.S. Pat. No. 2,999,788.

Although the fibrids and fibers may be of any aramid polymer, the low density, nonwoven sheet structure should comprise at least about 30% by weight fusible aramid. It is preferred that the fibrids and at least some of the short fibers be comprised of poly(m-phenylene isophthalamide), i.e. MPD-I, a preferred species of fusible aramid. For better fire resistance, particularly for protection against "break-open" upon exposure to flame, some of the short fibers preferably are comprised of poly(p-phenylene terephthalamide), i.e., PPD-T. A good balance of abrasion resistance and fire protection is provided with about an equal mixture by weight of fibers of PPD-T and MPD-I, such as 60% fibrids with 20% of each fiber type. For improved performance and compatibility in preparation of the sheet structures, the PPD-T fibers can be pulped to increase their fibrillar character as known in the art.

The invention also concerns an improved process for preparing an expanded nonwoven sheet comprised of aramid fibrids and short aramid fibers including the steps of forming a wet-laid sheet of said aramid materials, impressing a pattern of nonexpandable, densified regions into the sheet to enclose expandable portions of the sheet, and dielectrically heating the patterned sheet while wet with water to rapidly vaporize the water to create highly expanded portions in the sheet, said sheet comprising at least about 30% by weight fusible aramid, wherein the improvement comprises: drying the wet-laid sheet by passing it over a smooth heated surface under tension to remove substantially all water and provide a dry, smooth-surfaced sheet; preparing a layered sheet structure for expansion comprised of at least one layer of said dried sheet having a thickness of at least 4 mils, said layer having a thickness greater than 15 mils when there is only a single layer of said dried sheet, by fusing the materials together throughout the thickness of the layered sheet structure to form nonexpandable, densified regions, segmented by spaced interruptions of nonfused regions of the sheet structure, in a pattern which encloses expandable portions of the sheet structure, said densified regions occupying less than 50% of the sheet surface; saturating the patterned sheet structure with water; and uniformly expanding the expandable portions of the patterned sheet structure by dielectrically heating the wet sheet to rapidly vaporize water and expand the interior of the expandable portions substantially without disrupting their surfaces. When the sheet structure prepared for expanding consists of only one layer of the dried sheet, expansion occurs more readily if the thickness of the dried sheet is greater than about 15, and preferably greater than about 20, mils. When sheets of low basis weight are desired, the product is preferably made from two layers of dried sheet, having a thickness as low as 4 mils each.

The wet-laid sheets are suitably dried, without calendering, under tension over smooth-surfaced heated cans or rolls as known in the paper-making art.

To avoid the expansion of the sheet structure in the densified regions they may be formed by means of both heat and high pressure to fuse that portion of the aramid fiber which is fusible and preferably by the use of ultrasonic means which operates as its own heat source through ultrasonic vibration of the sheet material. The fused, densified regions are film-like and tend to be translucent.

Because of the increased difficulty in expanding such sheets after they have once been dried it is preferred that the water contain a dielectric coupling agent for more rapid heating.

To more effectively and readily saturate the layered sheet material with water prior to expansion, also it is preferred that the sheet be mechanically worked or stress-flexed dry or in the presence of water in order to facilitate pickup and penetration of water into its interior. This can be accomplished for example by passing the sheet in a sinusoidal path over a series of 90° edges, e.g., less than 1/16 in. radius, in a water bath. If stress-flexing is performed on the dry sheet, the sheet must be subsequently soaked. Such stress-flexing not only can reduce the time required for water to penetrate into the sheet, but also increase the water pickup and provide a more cellular interior structure within the expanded portions.

DETAILED DESCRIPTION OF THE INVENTION

A very surprising aspect of this invention is the ability to expand portions of the subject sheets after once being dried without substantial disruption of the sheet surface. Thus sheets can be prepared having a much smoother, less porous surface than ones prepared previously by expansion of wet-laid never-dried sheets. A further surprising aspect is the ability to control the nature of the interior of the expanded portions as mentioned above. The nature of these interiors is dependent upon a variety of factors including the area enclosed by the pattern of densified regions segmented by spaced interruptions of nonfused regions (the larger the area the more open and less sponge-like the interior), stress-flexing of the dried sheet prior to expansion which tends to provide a more cellular sponge-like interior, the dielectric coupling capability of the water in the sheet (as increased for example by the presence of a surfactant or dissolved ionized salt), the strength of the electric field during the dielectric expansion, the speed with which the sheet is passed through the heating zone (residence time), the thickness of the sheet being expanded, and the number of separate sheet layers used to make up the prepared sheet. Other possibilities include the layering of a never-dried nonwoven sheet between two dried sheets before forming the densified regions which when expanded can then provide a filled cellular internal structure with dense outer skins.

Of course the tensile strength of the resulting expanded sheet will depend, among other things, upon the thickness or basis weight of the sheet being expanded. For instance, sheets having a basis weight of about 6 ounces per square yard (200 g/m$^2$) and a thickness of about 23 mils (0.58 mm) typically can have a tensile strength of at least about 10 inch-pounds (11.53 kg-cm). Best tensile strength and abrasion resistance can be provided by sheets which have been heat set at a temperature sufficient to crystallize the polymer materials in the sheet.

Wetting of the sheets with tap water prior to expansion involves a water pickup of at least 75% by weight of the dry sheet; but a pickup of about 140% is preferred. Water containing dielectric coupling agents can reduce the percentage of pickup necessary for good expansion. Typically, a sheet with basis weight of about 6 oz/yd$^2$ (200 g/m$^2$) can be soaked in tap water for a period of about 50 seconds to obtain a water pickup of about 140% and provide good expansion. However, if it is desired to reduce water pickup, water containing up to 5% by weight of dielectric coupling agent can be sprayed on the surface of the sheet to a water content of as little as 50% and still produce good expansion.

Also to be noted, stress flexing as explained above can reduce the period of time required for water to penetrate the sheet, and can reduce the percentage of water needed for good expansion. Further, stress flexing can be used to enhance the expansion for sheets with low level water concentration.

Proper patterning of the sheet with the fused, densified regions segmented by spaced interruptions of nonfused regions provides control and uniformity of the expansion along, as well as across, the sheet during the expanding process. The spacing and patterning of the regions can be varied to achieve the desired degree of expansion.

It should be apparent that the invention offers a wide variety of styling possibilities depending upon such factors as the design or pattern enclosed by the fused densified regions and the nature of the sheet being expanded. Where they do not otherwise interfere with the performance of the sheet or the desired use, other materials such as mica, polyester, or carbon fiber may be incorporated into the sheet.

In accordance with the invention the low density, nonwoven sheet structure should comprise at least about 30% by weight fusible aramid. By "fusible aramid" is meant an aromatic polyamide which can be made into a fiber which, in fabric form, will meld or fuse within 10 seconds during exposure to a heat flux of 2 cal./cm$^2$/sec., measured as described by Burckel in U.S. Pat. No. 4,198,494 with respect to his "A" fiber component. A preferred species of such a fusible aramid is poly(m-phenylene isophthalamide).

The formation of the fused, densified regions may be accomplished by the use of any suitable heated embossing rolls, plates and the like, but an ultrasonic embossing or bonding apparatus is preferred. The anvil in an ultrasonic apparatus can be designed with appropriately raised portions which provide the desired pattern as the sheet is passed through the apparatus. Ultrasonic bonders can easily and uniformly provide bonding conditions comparable to greater than 4000 psi at 275° C. which are found to be effective. Proper fusion bonding is dependent on residence time and thickness of the sheet material. Such ultrasonic bonding conditions cause the fusible aramid portion of the sheet structure to form fused, densified regions so rapidly that substantially no degradation of the aramid occurs. Suitable patterns include diamond, square, rectangular, circular and other geometrical shapes defined by lines of fused, densified regions, segmented by spaced interruptions of nonfused regions, permitting the passage of vapor between the fused densified regions and within the smooth, dense, skin-like outer surfaces of the sheet during the expansion process, especially in direction of motion of the sheet. With patterns having small individually expanded portions, ultrasonic bonding appears to facilitate expansion of the small portions. Preferably the densified regions comprise only a fraction of, and for example 20% or less of, the total surface area of the sheet.

Known ultrasonic bonder apparatuses can be used to provide almost any desired fused densified pattern, with straight-lined geometric forms such as diamond or square shapes being preferred because of their simplicity and effectiveness. Particularly preferred are such patterns created by two groups of substantially parallel segmented lines having a distance between lines of at least about 1 cm (⅜ inch) and no greater than about 2.5 cm (1 inch) in each group. Ultrasonic bonding to create the pattern on the dry sheets provides not only a high degree of pattern versatility but also more effective fusion bonding which prevents blow-apart or delamination of the densified regions under conditions needed for the expansion process.

The fused densified regions suitably should be at least about 0.5 mm wide and about 1 mm long and be segmented by spaced interruptions of about equal length along the linear direction. About 1 mm round fused, dense regions also may be used. Such segmentation improves control of expansion from portion to portion along and across the expanded sheet.

The improved toughness and integrity of the surfaces of the sheets of this invention are apparent from their resistance to loss of material when an adhesive tape is applied to the surface and pulled away. This can be measured quantitatively with the Tape Pull Test as described herein in which sheets of the invention provide a loss of material of less than 4 mg/cm$^2$. Preferably in such a test the fused, densified regions show substantially no loss of material in this test. In general, as in abrasion resistance, the smaller the surface area of each expanded portion, the better the performance in the test. Accordingly, preferred sheet structures of the invention have discrete expanded portions which individually occupy a surface area within the range of from about 0.1 to about 25 cm$^2$ each.

In sheets containing mixtures of short fibers of MPD-I and PPD-T the fire resistance of the sheet increases as the quantity of the PPD-T fibers increases, but the abrasion resistance tends to decrease.

Preferred sheets of the invention have expanded portions with substantially smooth, two-dimensional surface (substantially free of loose filaments and visual surface irregularities, somewhat comparable to stationery paper) and can even have a somewhat glazed or glossy appearance, which is quite distinct from the rather irregular, textured, fuzzy and more porous surfaces of sheets prepared by the prior known never-dried process. In accordance with the invention the low density, nonwoven sheet structures are uniformly expanded. By "uniformly expanded," it is meant that substantially all of the portions of the sheet enclosed by the patterns of fused, densified regions segmented by nonfused portions of the sheet, are expanded convexly outward in both directions from the plane containing the fused, densified regions to a relatively uniform thickness at the centers of the expanded portions. The thickness of such uniformly expanded sheets has a relative standard deviation from the mean of ± about 15%, as measured by an optical thickness comparator after having severed the expanded sheet with a sharp blade or scissors on a straight line through the centers of the expanded portions and measuring each expanded portion from crest to crest on a line perpendicular to the plane containing the fused, densified regions which enclosed each individual expanded portion. If the upper and lower surfaces of an expanded portion stick together as the result of the cutting operation, the expanded portion is lightly flexed to pop it open. When the sheet contains different geometric patterns of expanded areas, direct expansion comparisons are made on expanded portions of like shape and area. A suitable optical comparator is a comparator having 6X magnification with an etched glass reticle bearing one or more suitable scales for measuring the thickness of materials (e.g., the 6X Junior Size Comparator listed in the 1981 Spring/Summer Edmund Scientific Catalog, No. 30,169 page 51).

The products of this invention, particularly the preferred product containing a mixture of fibers of poly(m-phenylene isophthalamide) and poly(p-phenylene terephthalamide), have sufficiently increased strength and abrasion resistance over never-dried expanded sheets to provide significantly improved wear life when used as fire blocking layers in aircraft, for instance as a carpet underlay and especially in aircraft seat cushions.

In general the larger the surface area of the puffed portion the more open is its central interior. Abrasion resistance and portion-to-portion uniformity tend to deteriorate with increasing area and especially with puffed portions having a surface area on each side of the sheet of greater than about 4 square inches.

Other uses for the products of this invention include insulation against fire, heat and sound and insulation linings in protective garments. Other uses are readily apparent from the physical and chemical properties of these light-weight sheets.

To enhance the physical properties of the low density nonwoven sheet structure of this invention, a reinforcing scrim may be attached to the structure, e.g. by ultrasonically bonding the scrim while simultaneously forming the fused, densified regions in the sheet structure. The reinforcing scrims may also be adhered to or incorporated with the structure by other methods. For best results in increased tensile properties and puncture resistance, the elongation of the reinforcing scrim should be similar to the elongation of the sheet structure.

This invention provides expanded aramid sheet products which can have an abrasion resistance of from 3 to 10× or more of that of the comparable sheets made by the known never-dried process.

Another advantage for the process of this invention versus the never-dried process of the prior art is improved productivity resulting from achieving expansion with less water (e.g., up to 5× less than that for the wet sheet process). Best results do require the use of a dielectric coupling agent such as Woolite® ionic surfactant, cetyl betaine surfactant, or ionic salts such as sodium sulfate.

Thermal insulating performance in this regard can be improved by tension-flexing of the samples before or during the wetting process to facilitate greater development of the inner cellular structure, but with some loss in tensile strength.

The dried sheets for use in the process of this invention for making the improved product can be prepared using known paper-making apparatus and techniques as taught for example in U.S. Pat. No. 3,756,908 and in EP 73,668.

TEST METHODS

Drip Porosity Test

This test is a measure of time elapsed for a specific sodium chloride-water solution to penetrate the expanded sheet product. The amount of time elapsed is a measure of the product's surface density and porosity. A product with denser, less porous surfaces will resist penetration and retain solution for a longer period of time.

A 0.95 l (1 qt) wide-mouthed jar ("Mason" home-canning jar), 12.4 cm (4⅞ in) high with a 6.4 cm (2.5 in) diameter mouth is employed for the test. An approximately 0.16 cm (0.0625 in) diameter vent hole is drilled into the bottom of the jar. The jar is provided with a conventional screw-top annular cap (ring) with a central opening 6.4 cm (2.5 in wide). To begin the test, the vent hole is plugged and the jar is filled with 600 ml of saline solution (0.9 wt % NaCl). A circular sample of the specimen of expanded product is cut so that it fits neatly within the screw-top annular cap, completely closing the central opening. Annular gaskets, such as of rubber, fitting within the annular cap and having central openings of the same dimension as the cap are placed above and below the circular sample to make a water-tight seal; the sample and gaskets are placed within the cap; and the cap is screwed tightly onto the jar so that the top of the jar is completely closed with the sample covering the central opening of the cap. The jar, with the vent hole plugged, is inverted onto a glass plate which is mounted approximately 20.3 cm (8 in) above a mirror. A stopwatch is started at the same moment as the vent hole is unplugged. The sample is observed in the mirror for penetration of the sample by the solution. Penetration is quickly and easily observed when solution penetrates the sample and wets the glass plate. Occasionally some condensation (a light "fog") will be observed on the surface of the glass; however, the appearance of the condensation is not considered as penetration of the sample by the solution. The time elapsed between the unplugging of the vent hole and wetting of the glass plate is recorded. If the solution penetrates the sample instantly when the jar is inverted, the time is recorded as zero seconds. The elapsed time for three randomly selected samples of each specimen tested is recorded and the average of the three elapsed times is reported as the result for the specimen.

Tape Pull Test

Tape pull delamination weight is a measure of the amount of material adhering to an adhesive tape after it has been applied, pressed and removed from the surface of fully dried, expanded product. The amount of material adhering to the tape is a direct measure of surface integrity and toughness. A tough structure will have a smaller amount of material adhering to the tape as opposed to a softer, less dense structure which gives larger amounts adhering to the tape.

For the test, one side of the expanded product to be tested is designated as the A side and the other as the B side. On the A side a line designated as the MD line is drawn in the machine direction if the machine direction is known or can be deduced, otherwise in an arbitrary direction. Machine direction refers to the "as made" direction from a commercial paper-making machine. Differences in the sides A and B are the result of the fiber laydown; the side laid down on forming wire differing from the exposed side. A line designated as the TD (transverse direction) line is drawn perpendicular to the MD line on the A side. Eight sample strips 2.5 cm (1 in) wide × 15.2 cm (6 in) long are cut from the expanded product, one set of four strips parallel to the MD line and another set of four strips parallel to the TD line, minimizing to the extent feasible the amount of embossed areas included within the sample strip and employing the same cutting pattern for the four strips cut in each direction so that all the strips cut in a given direction resemble one another.

The tape used for the test is a substantially transparent tape, 2.5 cm (1 in) wide and having adhesive on one side only (Scotch® brand 810 Magic Transparent Tape made by the 3M Co.). In ASTM test D-3330-76 (180° Peel Adhesion test), the tape tests 279 g/cm (25 oz/in) for adhesion to steel. Tape is applied to each sample strip, evenly covering the entire width of the sample strip, from one end to about 0.6 cm (0.25 in) short of the other end, folding the tape back on itself to provide a tab of double thickness about 0.6 cm (0.25 in) long with the adhesive surfaces inside and adhered to one another near the end of the strip not quite reached by the tape. Of the four samples in each of the MD and TD sets, tape is applied to the A side in two of the samples in each set, with the tabs being at opposite ends of these two samples, and to the B sides in two of the samples in each set, again with the tabs being at opposite ends of these two samples. The samples, each with tape already applied to it, are then pressed between platens at 11.5 MPa (1667 psi).

The full width of the tab end of a sample strip (the end not completely covered by tape) is then firmly grasped in the lower jaw of a tensile tester ("Instron" Model 1130 with a 500 g load cell) while the full width of the tab end of the tape is firmly grasped by a clamp attached to the upper jaw of the tensile tester. The tensile tester is then started and the jaws are moved apart at the rate of 30.5 cm (12 in) per min. When the tape has been completely pulled away from the sample, the machine is stopped.

From each strip of pulled-off tape a 12.7 cm (5 in) long piece is precisely cut and weighed on a balance to the nearest 0.01 g. The average weight of a clean 12.7 cm strip is then determined and subtracted from the weight of the 12.7 cm pulled-off strips to determine the weight of adhered surface material removed from each test strip.

The eight sample strips yield eight measurements per test sheet and the average of the eight results is reported in milligrams per square centimeter.

Taber Abrasion Test

This test is carried out in accordance with ASTM Test Method D-1175-64T, page 283 (Rotary Platform, Double Head Method), using CS-10 grit size abrasive wheels applied against the specimen with a load of 500 g per wheel. Failure is judged to occur when a hole of any size passing completely through the sheet can be observed. Results are reported as cycles to failure. Preferred products of the present invention survive 1000 or more cycles to failure, although for some end uses products having lower resistance to abrasion are satisfactory.

Seat Wear Test (Boeing's "Squirmin Herman" Seat Wear Life Test)

This test is carried out by preparing conventional airplane seat cushions having a polyurethane foam composition interior surrounded by an inner lining formed of the expanded sheet product to be tested and an exterior lining of conventional seat cushion fabric, e.g., wool/nylon (90/10) seat-cover fabric having a basis weight of 441 g/m$^2$ (13 oz/yd$^2$). The expanded sheet product is sewn to the inside of the seat-cover fabric, and the seat cover is fashioned for ready removal for inspection of the expanded sheet product, e.g., by including a zipper for opening up the seat cushion when desired.

The seat cushion is then tested on the seat wear-tester apparatus shown in FIG. 2 of the article "Textiles is Ready When You Are" by Sally A. Hasselbrack in *Textile World*, May, 1982, page 100. The wear-test device includes a seat weight made of soft rubber, weighing 64 kilograms (140 lbs) and fashioned in the form of a seated human posterior, enclosed by a pants-like cover made of 100% polyester 2-bar tricot knit fabric. In a 2-minute cycle, the seat tester is in contact with the seat cushion for 1 minute and 40 seconds and lifted off the cushion for 20 seconds. While in contact with the cushion, the seat tester is rocked through a 25 degree arc at 13.5 cycles per minute while the cushion rotates through a 35 degree arc at 18 cycles per minute. The test is stopped and the seat cushion fabric with attached inner lining is removed periodically to inspect the lining. Failure of the inner lining is judged to occur when a hole of any size passing completely through the lining can be observed. If the lining is intact after 50 hours of testing, the expanded sheet product is rated as having passed the test.

EXAMPLE 1

This example illustrates the preparation of expanded sheets of this invention and the fabrication of flame-resistant airplane seat cushions from the expanded sheets.

The aramid papers for making these expanded sheets were all prepared conventionally using a commercial Fourdrinier paper-making machine. Fibrids of poly(m-phenylene isophthalamide) (MPD-I) at about 0.5 weight percent in tap water were fed to one inlet port of a mixing "tee". A 50/50 slurry of 0.64 cm (0.25 in) long, 2.2 decitex (2-denier) MPD-I floc/poly(p-phenylene terephthalamide) (PPD-T) 4 mm long (average of 0.5–8 mm lengths), pulped floc of 450–575 Canadian Standard Freeness at about 0.35 weight percent in tap water was fed to the other inlet port of the mixing "tee". Fibrid-to-floc-to-pulp ratio by weight was 60/20/20. Effluent was fed to the headbox and then to the forming wire. The resultant sheet was passed over the steam-heated drying cans maintained at a surface temperature of 140° C. for an exposure time of 2 minutes and wound up as a fully dried sheet on a cylindrical cardboard roll. The process was operated with paper-making machine settings calculated to provide 0.58 mm (23 mil) thick dried sheets having a basis weight of about 200 g per m$^2$ (about 6 oz per yd$^2$).

The dried sheets were then ultrasonically embossed by unwinding the sheets from the cardboard rolls and passing each sheet to an ultrasonic embossing station wherein each sheet was embossed between an ultrasonic horn and an anvil. The horn employed (a product of Branson Co., Eagle Road, Danbury, Conn.) had an impact surface measuring 15.2 cm (6 in) long by 1.3 cm (0.5 in) wide. The horn, with the sheet in between, was pressed up against a 15.2 cm (6 in) long patterned rotating anvil (drum) having a surface speed of about 10–13 ft/min and a diameter of 7.6 cm (3 in) with peripheral lines of rectangular protrusions measuring 1.9 mm (0.075 in) long by 0.64 mm (0.025 in) wide, spaced 1.9 mm (0.075 in) apart, lying in planes normal to the axis of the anvil. The horn vibrated at a frequency of 20,000 cycles per second and an air pressure setting of 20–30 psi on the machine was used to obtain pressure between the anvil and horn. In this example two different anvils were employed, one having lines of protrusions lying in planes spaced 1.3 cm (0.5 in) apart and the other having lines of protrusions lying in planes spaced 2.5 cm (1 in) apart. Two sheets were separately embossed on each anvil, passing them between the horn and anvil sufficient times as needed to cover the full sheet width (each pass parallel to the previous pass at the appropriate spacing) in one direction and then sufficient times in the cross direction to produce two pairs of sheets each pair having square pattern arrays of squares measuring 1.3 cm (½ in) on a side or 2.5 cm (1-in) on a side, respectively, each square being enclosed by parallel lines of fused, densified regions of equal length segmented by spaced interruptions of nonfused regions of about the same length.

In turn, the four embossed sheets were then each wetted by passing them through a tank of tap water to which 1 wt. % ionic surfactant ("Woolite") had been added. The sheets were passed through the tank at the rate of 61 cm per min (2 ft per min) for a contact time of 23 seconds. The wetted sheets having at least about 120% water were then dielectrically expanded by passing them from the tank through a 20 KW dielectric heater operating at 27 MHz. The sheets were passed between a single set of 122 cm (48 in) electrodes, spaced 5–8 cm (2–3 in) apart.

The sheets have discrete, uniformly expanded portions enclosed by the parallel lines of fused, densified regions of equal length segmented by spaced interruptions of nonfused regions of about the same length to form a pattern of squares, with each expanded portion being comprised of a chamber formed by two, opposed, smooth, dense, skin-like surface strata which enclose an interior in which the material density increases outwardly from a less dense central region through a denser cellular sponge-like or laminar region to two opposed dense skin-like surface strata. The sheets with the larger pattern have expanded portions with more open interiors.

Two of the dielectrically expanded sheets having different sizes of embossed pattern arrays were then heat treated, while the other two were not heat treated. The heat setting was carried out on a frame (Bruckner frame) at minimum tension at 260° C. for 3 min. The four resulting sheets are designated as follows:

Test Item A—embossed squares 1.3 cm on each side; not heat set.

Test Item B—embossed squares 1.3 cm on each side; heat set.

Test Item C—embossed squares 2.5 cm on each side; not heat set.

Test Item D—embossed squares 2.5 cm on each side; heat set.

The four sheets prepared as described above were then sewn as a liner to the inside of woven wool/nylon (90/10) seat cover fabric having a basis weight of 441 g/m$^2$ (13 oz/yd$^2$). The lined fabrics were then used to prepare conventional airplane seat cushions, with the embossed, expanded sheets as an inner lining surrounding the polyurethane foam composition from which the seat cushions were made. When seat cushions made from the four test item sheets were tested by the Seat Wear Test, cushions made of each of the test items passed the test (no break in the protective expanded sheet after 50 hours of testing). Item B was tested longer and still passed after 100 hrs. Mock seat cushions made of each of the test items also pass Boeing's OSU Heat Release Test (no involvement of the polyurethane foam by the flame for at least 30 seconds) at 5 watts/cm$^2$. Other properties of the four expanded sheet test items are listed in the table:

| Item | Drip Porosity (seconds) | Taber Abrasion Resistance (cycles to failure) | Tape Pull Test (mg/cm$^2$) |
|---|---|---|---|
| A | 13 | 4300 | 0.81 |
| B | 18 | 6500 | 1.36 |
| C | 16 | 1800 | 1.3 |
| D | 19 | 2500 | 1.18 |

Three comparable expanded sheets, not of the invention, but of the same 60/20/20 composition [except for 2 mm (average of 0.5–4 mm lengths) long PPD-T fibers instead of 4 mm with a Canadian Standard Freeness of 300–425], were made in substantially the same way except for expanding never-dried sheet which had a water content of 80–84% by weight as made (400–525% by weight of water, based on solids content) with additional water added prior to the expansion step, and for a room temperature, mechanically-embossed diamond pattern (4.45 cm × 1.91 cm and 2.5 mm wide continuous densified lines) pressured into the wet sheet. The expanded sheets have a very rough textured, three dimensional surface to the naked eye. A nonheat-set expanded sheet gave instant wetting (zero seconds) in the drip porosity test and 500 cycles to failure in the Taber abrasion test. Two heat-set expanded sheets (30 seconds and 3 minutes at 260° C.) gave, respectively, one second and 650 cycles and zero seconds and 700 cycles in the same tests showing them all to be quite inferior in these tests to the sheets of the invention. Tape Pull results for the three items are, respectively, 5.79, 5.79 and 6.3 mg/cm$^2$. Tested as linings in the conventional seat wear tester, the first one failed, the second one passed marginally and the third passed. However, although the third one passed, its bulk and drapability were somewhat impaired because of heat-setting.

EXAMPLE 2

This example illustrates the preparation of sheets of this invention from two separate sheets of aramid papers which are bonded together and subsequently expanded.

The aramid papers for making these expanded products were all prepared conventionally using a commercial Fourdrinier paper-making machine from about 55% MPD-I fibrids and about 45% MPD-I 2.2 decitex (2 denier) floc having a cut length of 0.64 cm (0.25 in). After the wet sheets were formed on the machine, they were passed over a series of drying cans maintained at temperatures ranging from 85° C. to 115° C. for papers of lower basis weight to 110°–140° C. for higher basis weight papers, using contact times suitable to dry the papers. The papers were not subsequently calendered.

In one embodiment two fully dried 0.3 m (1 ft) wide, 0.6 m (2 ft) long sheets of aramid paper, each having a basis weight of 40.7 g/m$^2$ (1.2 oz/yd$^2$) and actually measuring 0.10 mm (4 mil) thick (commercially available as nominally 5 mil thick paper) were brought together at the ultrasonic embossing station described in Example 1. The sheets were superimposed, one upon the other, and were ultrasonically embossed and bonded together in the parallel lines of fused, densified regions segmented by spaced interruptions of nonfused regions of about the same length to form a pattern of square arrays of 1.3 cm (0.5 in) on a side.

The embossed sheets were then wetted by passing them through a tank of tap water to which 2 ½ wt % ionic surfactant ("Woolite") had been added. The wetted sheets were then dielectrically expanded. The resultant product maintained good bonding integrity in the embossed fused densified regions enclosing uniformly expanded portions with open balloon-like chambers formed by two dense, smooth, tough skins. The operating conditions for wetting and dielectric expansion were similar to those described in Example 1 except that residence time and field intensity were increased.

In another embodiment, two fully dried sheets of aramid paper of different thicknesses were ultrasonically bonded together. One sheet was 0.25 mm (10 mil) thick having a basis weight of 81.4 g per m$^2$ (2.4 oz/yd$^2$). The other sheet was 0.38 mm (15 mil) thick having a basis weight of 129.9 g/m$^2$ (3.8 oz/yd$^2$). The two sheets were ultrasonically embossed, bonded, wetted, and dielectrically expanded as described above. The resultant product was similar to that prepared above; however, some development of an inner cellular or laminar structure in the expanded portions on the inside surface of the skin strata was observed in this thicker sheet.

The resultant products from the two embodiments are designated as follows:

Test Item II-A: 4 mil sheet bonded to 4 mil sheet.

Test Item II-B: 10 mil sheet bonded to 15 mil sheet.

| | Properties of the expanded sheets are: | |
|---|---|---|
| Item | Drip Porosity (seconds) | Abrasion Resistance (cycles to failure) |
| II-A | 24 | 339 |

-continued

| Item | Properties of the expanded sheets are: Drip Porosity (seconds) | Abrasion Resistance (cycles to failure) |
|---|---|---|
| II-B | 35 | 4453 |

EXAMPLE 3

Dried 23 mil sheet of substantially the same MPD-I composition of Example 2 was ultrasonically embossed in square patterns (½ in and 1.0 in) as in Example 1. The sheet was then "stress-flexed" by pulling over a 90° edge of a hand held brass block while immersed in a liquid of 2½% "Woolite" and tap water. After multiple stresses (8 times), 2 times each way in the machine direction for both sides the sheet remained in the liquid for a total of 1.0 minute. The sheet was then dielectrically heated in an 85 MHz RF heater with one single set of electrodes spaced 3.0 in apart at a belt speed of 3.0 ft/min. The resulting product readily expanded to form discrete uniform expanded portions with dense, smooth skin-like surface strata and much less dense interiors.

What is claimed is:

1. A low density, nonwoven sheet structure consisting essentially of a commingled mixture of from 30 to 90% by weight of aramid fibrids and complementally from 70 to 10% by weight of short aramid fibers, said sheet comprising at least about 30% by weight fusible aramid, the sheet having uniformly expanded portions enclosed by a pattern of fused, densified regions segmented by spaced interruptions of nonfused regions with the expanded portions being comprised of a chamber formed by two opposed, dense, smooth, skin-like surface strata of said fibrids and fibers which two strata enclose a much less dense interior, the sheet having a sufficiently low porosity to provide a Drip Porosity Test time of at least about 10 seconds.

2. A sheet structure of claim 1 having a basis weight of less than about 7 oz/yd$^2$ and an abrasion resistance in the Taber abrasion test of at least 1000 cycles to failure.

3. A sheet structure of claim 1 in which the densified regions have a surface integrity resulting in substantially no loss of material by visual examination to the naked eye in the Tape Pull test.

4. A sheet structure of claim 1 in which the fused, densified regions enclose discrete expanded portions and are arranged in a geometric pattern of segmented lines.

5. A sheet structure of claim 4 wherein discrete expanded portions individually occupy a surface area of the sheet within the range of from about 0.1 to about 25 cm$^2$ each.

6. A sheet structure of claim 5 having a surface integrity sufficient to provide a loss of material in the Tape Pull test of less than 4 mg/cm$^2$.

7. A sheet structure of claim 1 in which the fibrids and at least some of the short fibers are comprised of poly(m-phenylene isophthalamide).

8. A sheet structure of claim 7 in which from about 10 to 30% of the sheet by weight consists of short fibers of poly(p-phenylene terephthalamide).

9. A sheet structure of claim 7 consisting essentially of fibrids and short fibers of MPD-I and short fibers of PPD-T in a ratio by weight of about 60/20/20 respectively, and the PPD-T fibers have been pulped.

10. A sheet structure of claim 1 in which the material density in the interior of the expanded portions increases with distance from a less dense center towards the surface strata through an increasingly dense sponge-like cellular region and culminating in the more dense skin-like surface strata.

11. A sheet structure of claim 1 wherein the expanded portions consist essentially of the dense skin-like surface strata and an open interior substantially free of fibrid/fiber matter in a balloon-like configuration.

12. A sheet structure of claim 11 in which the surface strata are derived from separate sheets of said fibrids and fibers which sheets are fused together in said densified regions.

13. A sheet structure of claim 12 having a basis weight of less than about 3 oz/yd$^2$.

14. An improved process for preparing an expanded nonwoven sheet comprised of aramid fibrids and short aramid aramid including the steps of forming a wet-laid sheet of said aramid materials, impressing a pattern of nonexpandable, densified regions into the sheet to enclose expandable portions of the sheet, and dielectrically heating the patterned sheet while wet with water to rapidly vaporize the water to create highly expanded portions in the sheet, said sheet comprising at least about 30% by weight fusible aramid wherein the improvement comprises:

drying the wet-laid sheet by passing it over a smooth heated surface under tension to remove substantially all water and provide a dry, smooth-surfaced sheet;

preparing a layered sheet structure for expansion, comprised of at least one layer of said dried sheet, having a thickness of at least 4 mils, said layer having a thickness greater than 15 mils when there is only a single layer of said dried sheet, by fusing by ultrasonic means the materials together throughout the thickness of the layered sheet structure to form nonexpandable, densified regions, segmented by spaced interruptions of nonfused regions of the sheet structure, in a pattern which encloses expandable portions of the sheet structure, said densified regions occupying less than 50% of the sheet surface;

saturating the patterned sheet structure with water;

and uniformly expanding the expandable portions of the patterned sheet structure by dielectrically heating the wet sheet to rapidly vaporize water and expand the interior of the expandable portions substantially without disrupting their surfaces.

15. A process of claim 14 wherein the fibrids and at least some of the short fibers are comprised of poly(m-phenylene isophthalamide).

16. A process of claim 15 wherein expandable portions enclosed by said fused, densified regions are discrete and individually occupy a surface area of from about 0.1 cm$^2$ to about 25 cm$^2$.

17. A process of claim 16 wherein the fused, densified regions are arranged in a geometric pattern of segmented lines.

18. A process of claim 14 wherein a single dry sheet is used having a thickness greater than about 20 mils.

19. A process of claim 14 wherein the layered sheet structure consists of two of said wet-laid, dried sheets with each having a thickness of at least about 4 mils.

20. A process of claim 14 wherein the sheet structure is stress-flexed before dielectric heating.

21. A process of claim 14 wherein the sheet structure is stress-flexed while dry.

22. A process of claim 14 wherein the sheet structure is stress-flexed while wet.

* * * * *